US006851652B1

(12) United States Patent
Huang

(10) Patent No.: US 6,851,652 B1
(45) Date of Patent: Feb. 8, 2005

(54) TELESCOPIC SUPPORT

(76) Inventor: Han-Ching Huang, No. 12, Alley 111, Lane 437, Chen Hsing Road, Taichung (TW)

( * ) Notice: Subject to any disclaimer, the term of this patent is extended or adjusted under 35 U.S.C. 154(b) by 0 days.

(21) Appl. No.: 10/666,107

(22) Filed: Sep. 18, 2003

(51) Int. Cl.[7] ..... E04G 25/00
(52) U.S. Cl. ..... 248/200.1
(58) Field of Search ..... 74/577 R, 575; 248/200.1, 407, 408, 422, 161, 185.5; 296/6; 254/114, 116, 93 H

(56) References Cited

U.S. PATENT DOCUMENTS

| | | | | | |
|---|---|---|---|---|---|
| RE5,094 | E | * | 10/1872 | Mathewson | 248/408 |
| 3,875,822 | A | * | 4/1975 | Erith et al. | 74/575 |
| 4,281,820 | A | * | 8/1981 | Martin | 254/133 R |
| 5,572,908 | A | * | 11/1996 | Bruder | 74/577 R |
| 5,787,761 | A | * | 8/1998 | Wang | 74/535 |
| 6,152,434 | A | * | 11/2000 | Gluck | 269/6 |
| 6,547,684 | B2 | * | 4/2003 | Kurohata | 474/111 |
| 2003/0173475 | A1 | * | 9/2003 | Hsieh | 248/161 |

FOREIGN PATENT DOCUMENTS

| | | | | |
|---|---|---|---|---|
| DE | 19541745 A1 | * | 5/1997 | |
| JP | 2-20459 | * | 1/1990 | 74/575 |

* cited by examiner

*Primary Examiner*—Ramon O Ramirez
(74) *Attorney, Agent, or Firm*—Alan D. Kamrath; Nikolai & Mersereau, P.A.

(57) ABSTRACT

A telescopic support includes a tube and an elongated element inserted in the tube and formed with a series of ratchets. A driving and locking device includes a locking element, a spring and a driving element. The locking element includes a jaw formed with at least one ratchet and being pivotally installed on the tube. The spring is provided between the tube and the locking element for biasing the ratchet of the locking element into engagement with the ratchets of the elongated element. The driving element includes a jaw formed with at least one ratchet. The driving element can be pivoted on the tube in a direction so as to engage the ratchet thereof with the ratchets of the elongated element. The driving element can be pivoted in an opposite direction so as to disengage the ratchet thereof from the ratchets of the elongated element and pivot the locking element for disengaging the ratchet of the locking element from the ratchets of the elongated element.

19 Claims, 11 Drawing Sheets

TELESCOPIC SUPPORT

DEFINITION

The term "tension-type" refers to a property that two elements are drawn back into each other in use, thus imposing tension on the elements.

The term "compression-type" refers to a structure of two elements that are extended from each other in use, thus imposing compression on the elements.

FIELD OF INVENTION

The present invention relates to a telescopic support.

BACKGROUND OF INVENTION

Referring to FIGS. 10–12, a tension-type telescopic support 60 includes an internal tube 62 in which a series of slots 64 is defined. The internal tube 62 can be inserted in an external tube 66. A frame 68 is installed on and around the external tube 66. The frame 68 includes two parallel fins 70 each formed with a cam 72. A restraining element 74 is installed on the fins 70. A locking element 76 is movably mounted on the fins 70. The locking element 76 includes two detents 78. A spring 80 is installed between the restraining element 74 and the locking element 76. A lever 82 includes a handle 84, two fins 86 extending from the handle 84 and two cams 88 each formed on one fin 86. The cams 88 are rotationally installed on the cams 72. A wheel 90 is rotationally installed on the cams 72. The wheel 90 includes a central gear 92 and two lateral gears 94 each formed on a side of the central gear 92. The central gear 92 is formed with teeth 96. Each lateral gear 94 is formed with ratchets 98 for engagement with the detents 78. A retaining element 100 includes a plate 102 at an end and a handle 104 at another end. The plate 102 is movably mounted on the fins 86. A spring 106 is provided between the retaining element 100 and the handle 84.

Referring to FIG. 11, one tooth 96 is inserted in one slot 64. The lever 82 is in a locking position. The detents 78 are engaged with the ratchets 98. The wheel 90 cannot be rotated counterclockwise. Thus, the internal tube 62 cannot be pulled from the external tube 66.

Referring to FIG. 12, one tooth 96 is inserted in one slot 64. The lever 82 is in a releasing position. The cams 88 push the locking element 76 so as to disengage the detents 78 from the ratchets 98. The wheel 90 can be rotated. Thus, the internal tube 62 can be pulled from or drawn back into the external tube 66.

This tension-type telescopic support is structurally complicated for using many elements. It is time-demanding to assemble this tension-type telescopic support. Every time the lever 82 is pivoted, the plate 102 contacts only one tooth 96. Thus, the wheel 90 is only rotated by an angle between two adjacent teeth 96. That is, the wheel 90 moves the internal tube 62 only by a distance between two slots 64. Therefore, it is slow to operate this tension-type telescopic support.

The present invention is therefore intended to obviate or at least alleviate the problems encountered in the prior art.

SUMMARY OF INVENTION

It is an objective of the present invention to provide a structurally simple telescopic support.

It is another objective of the present invention to provide an easily operable telescopic support.

According to the present invention, a telescopic support includes a tube and an elongated element inserted in the tube and formed with a series of ratchets. A driving and locking device includes a locking element, a spring and a driving element. The locking element includes a jaw formed with at least one ratchet and being pivotally installed on the tube. The spring is provided between the tube and the locking element for biasing the ratchet of the locking element into engagement with the ratchets of the elongated element. The driving element includes a jaw formed with at least one ratchet. The driving element can be pivoted on the tube in a direction so as to engage the ratchet thereof with the ratchets of the elongated element. The driving element can be pivoted in an opposite direction so as to disengage the ratchet thereof from the ratchets of the elongated element and pivot the locking element for disengaging the ratchet of the locking element from the ratchets of the elongated element.

Other objectives, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
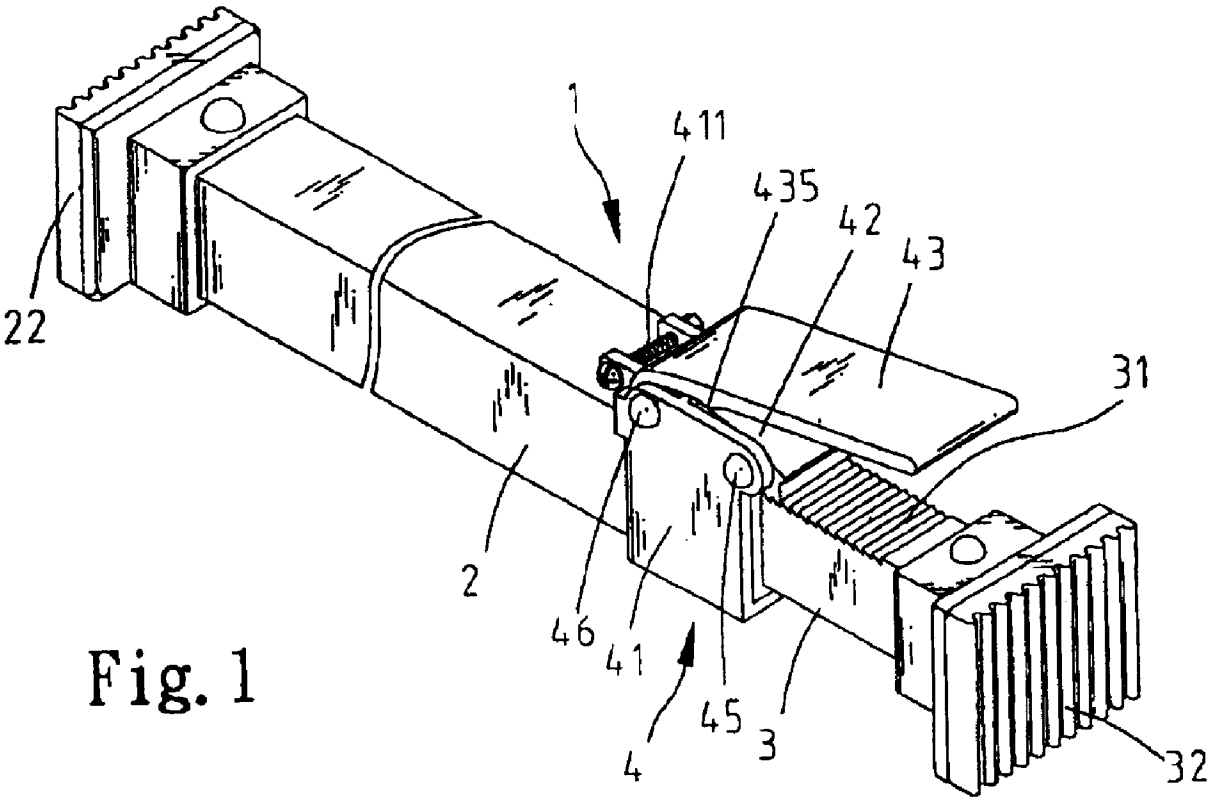
FIG. 1 is a perspective view of a telescopic support according to a first embodiment of the present invention.

Referring to FIG. 1, according to a first embodiment of the present invention, a telescopic support 1 includes an external tube 2, an elongated member shown in the preferred form of an internal tube 3 and a driving and locking device 4. The internal tube 3 is inserted in the external tube 2. The driving and locking device 4 is used to extend the external tube 2 from the internal tube 3 and avoid the external tube 2 drawing back into the internal tube 3.

The external tube 2 defines a longitudinal space 21 for receiving the internal tube 3. A pad 22 is attached to an end of the external tube 2. The pad 22 is for frictional contact with a wall, ceiling or floor.

The internal tube 3 includes a series of ratchets 31 formed thereon. A pad 32 is attached to an end of the internal tube 3. The pad 32 is for frictional contact with a wall, floor or ceiling.

The driving and locking device 4 includes a frame 41, a locking element 42 and a driving element 43.

The frame 41 is U-shaped as it is viewed in a longitudinal direction, i.e., it includes two terminal flat portions that are separate from each other by a gap. The frame 41 is mounted on and around the external tube 2. A fastening device 411 is provided to move the terminal flat portions of the frame 41 toward each other. Thus, the frame 41 is tightly mounted on and around the external tube 2. The fastening device 411 may be a combination of a bolt with a nut as shown in FIG. 1 or any other appropriate device.

The locking element 42 is pivotally installed on the terminal flat portions of the frame 41 by means of a shaft 45. The locking element 42 includes a first section formed as a jaw 421 and a second section formed as a lever 422. On the jaw 421 are formed several ratchets 424 for engagement with the ratchets 31. A spring 423 is provided between one terminal flat portion of the frame 41 and the lever 422 of the locking element 42 so as to bias the locking element 42 in a direction so that the ratchet 424 are kept in engagement with the ratchets 31.

The driving element 43 is pivotally installed on the terminal flat portions of the frame by means of a shaft 46. The driving element 43 includes a first section formed as a jaw 431 and a second section formed as a lever 432. On the jaw 431 are formed several ratchets 434 for engagement with the ratchets 31. A spring 433 is provided between one terminal flat portion of the frame 41 and the jaw 431 of the driving element 43 so as to bias the driving element 43 in a direction so that the ratchet 434 are kept from the ratchets 31. The lever 431 is formed with a convex portion 435 for contact with the lever 422 of the locking element 42.

Figure 2:
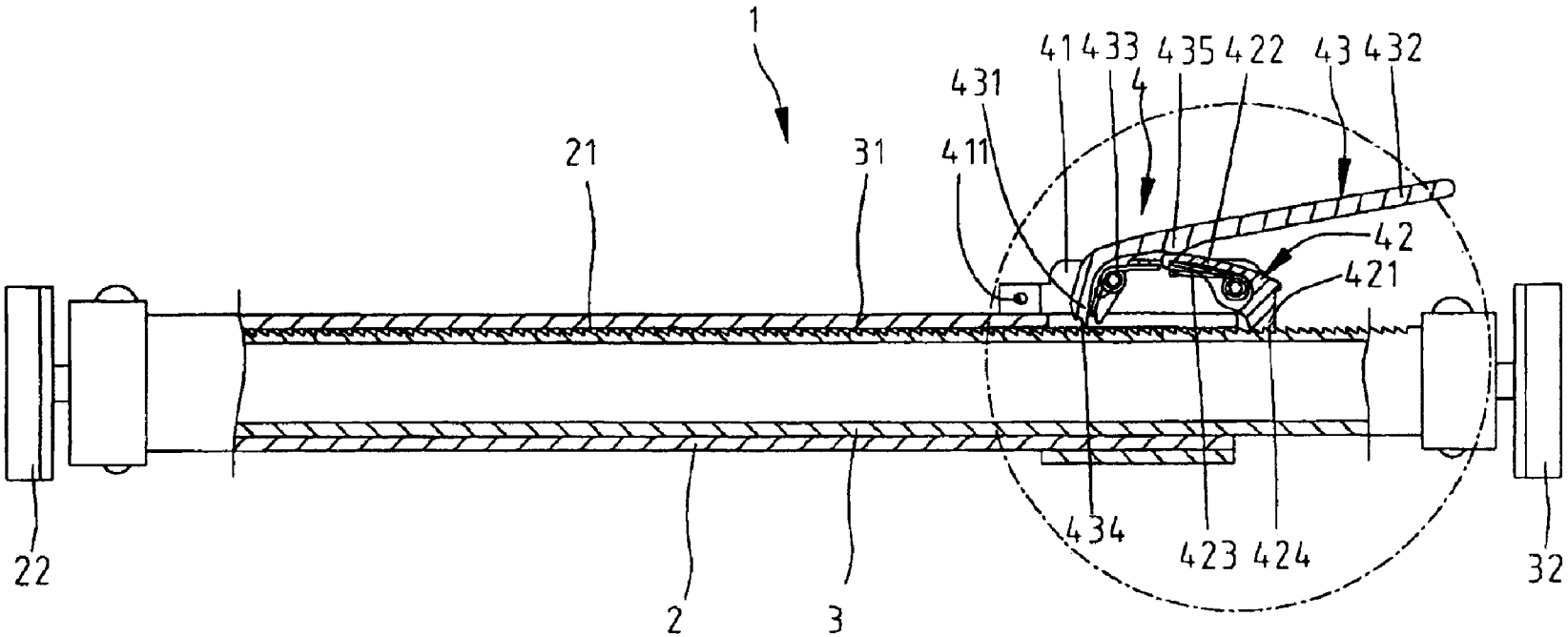
FIG. 2 is a cross-sectional view of the telescopic support of FIG. 1.
Figure 3:
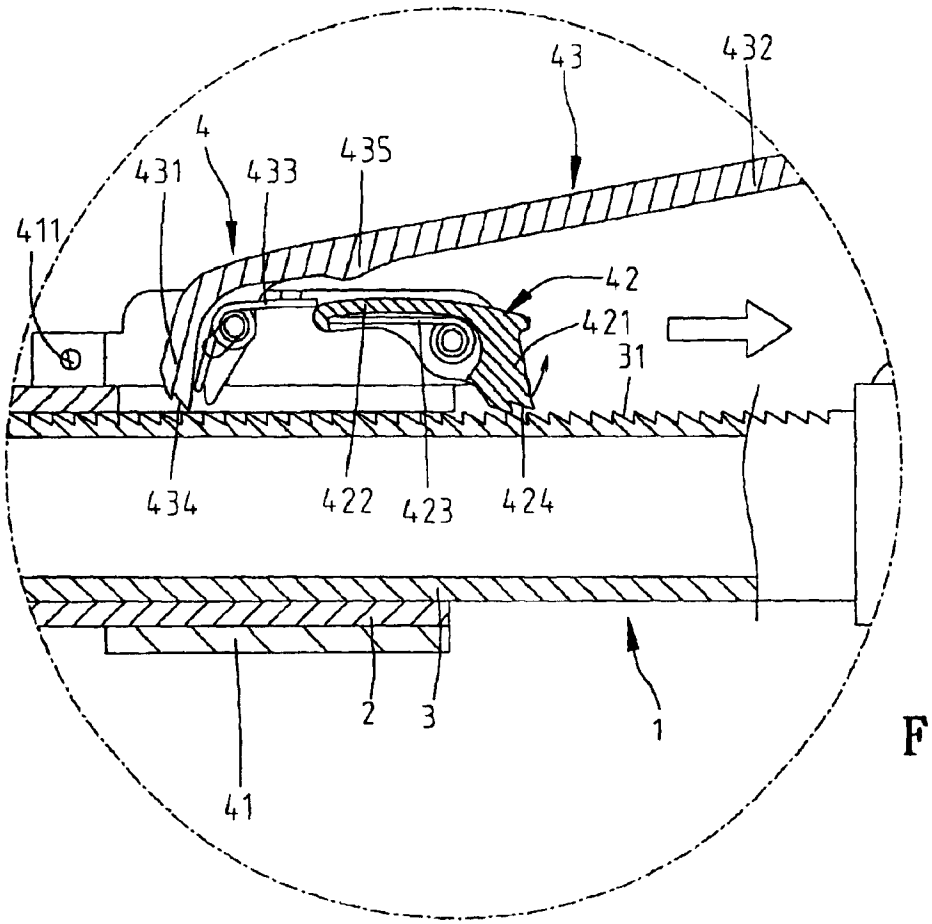
FIG. 3 is an enlarged partial view of the telescopic support of FIG. 2.

Referring to FIGS. 2 and 3, as the first driving and locking device 42 and the second driving and locking device 43 are both in their normal position, the ratchets 424 are engaged with some of the ratchets 31 so that the internal tube 3 can be pulled from the external tube 2 but into the external tube 2. Although not shown, in use, the internal tube 3 is pulled from the external tube 2 so that the pad 32 contacts a wall, ceiling or floor and the pad 22 contacts another wall, floor or ceiling.

Figure 4:
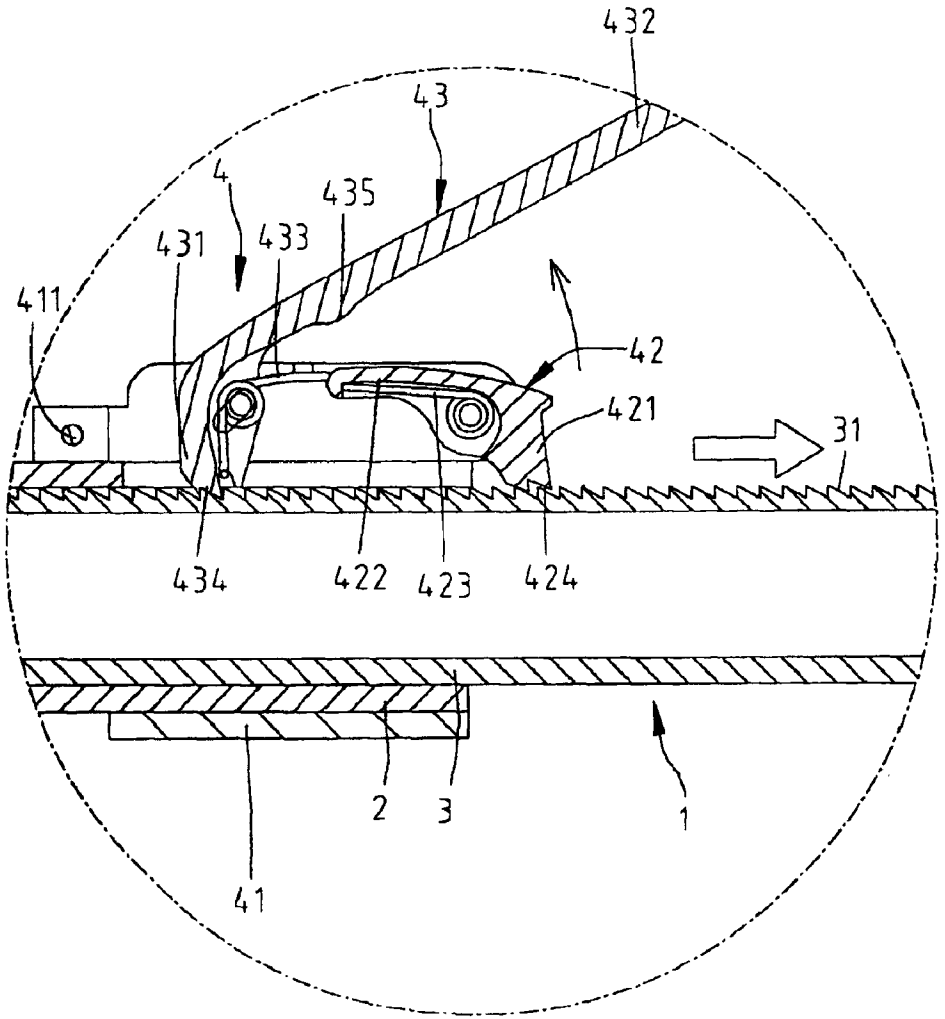
FIG. 4 is similar to FIG. 3 but shows the telescopic support in a different position.

Referring to FIG. 4, to have the pad 32 firmly contact the wall, ceiling or floor and the pad 22 contact the other wall, floor or ceiling, and the internal tube 3 needs to be pulled from the external tube 2 by a small amount. To this end, the driving element 43 is pivoted in a first direction thereof so that the ratchets 434 are brought into engagement with some of the ratchets 31. The driving element 43 is further pivoted in the first direction so that the jaw 431 moves the internal tube 3 from the external tube 2.

Figure 5:
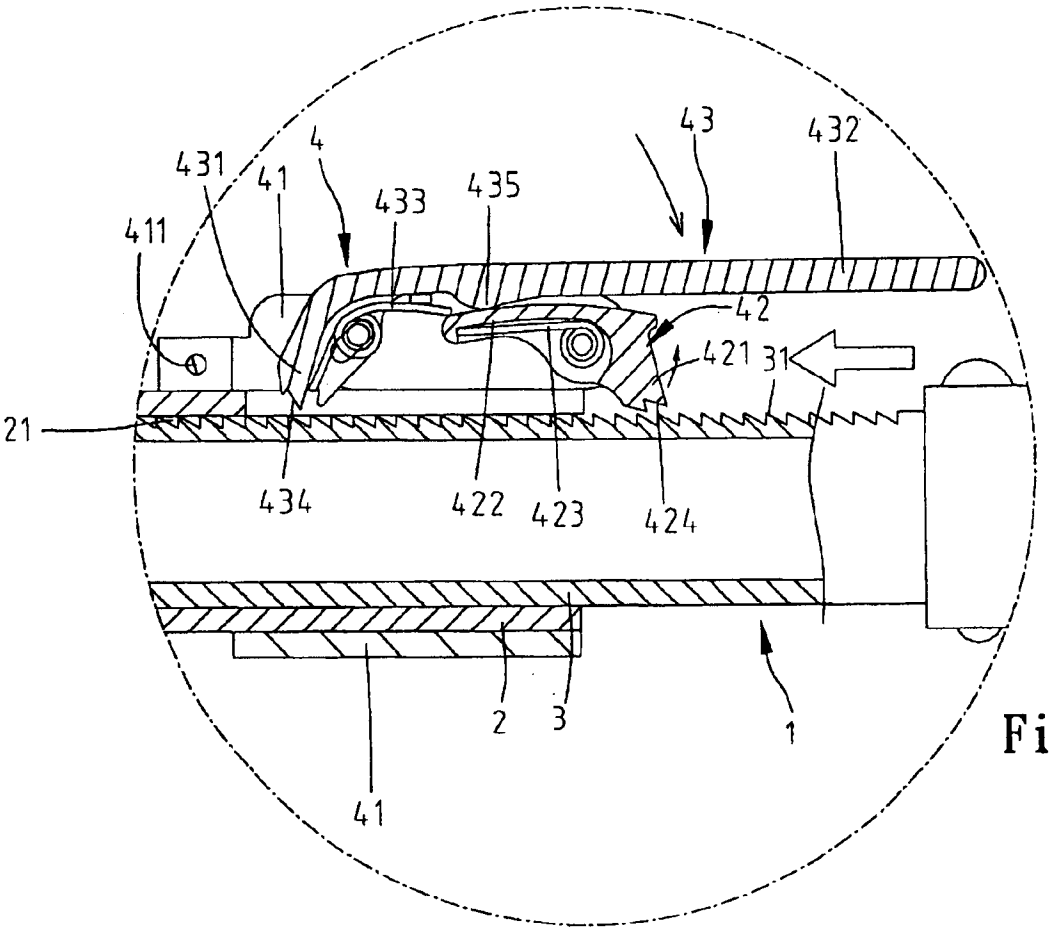
FIG. 5 is similar to FIG. 4 but shows the telescopic support in a different position.
Figure 6:
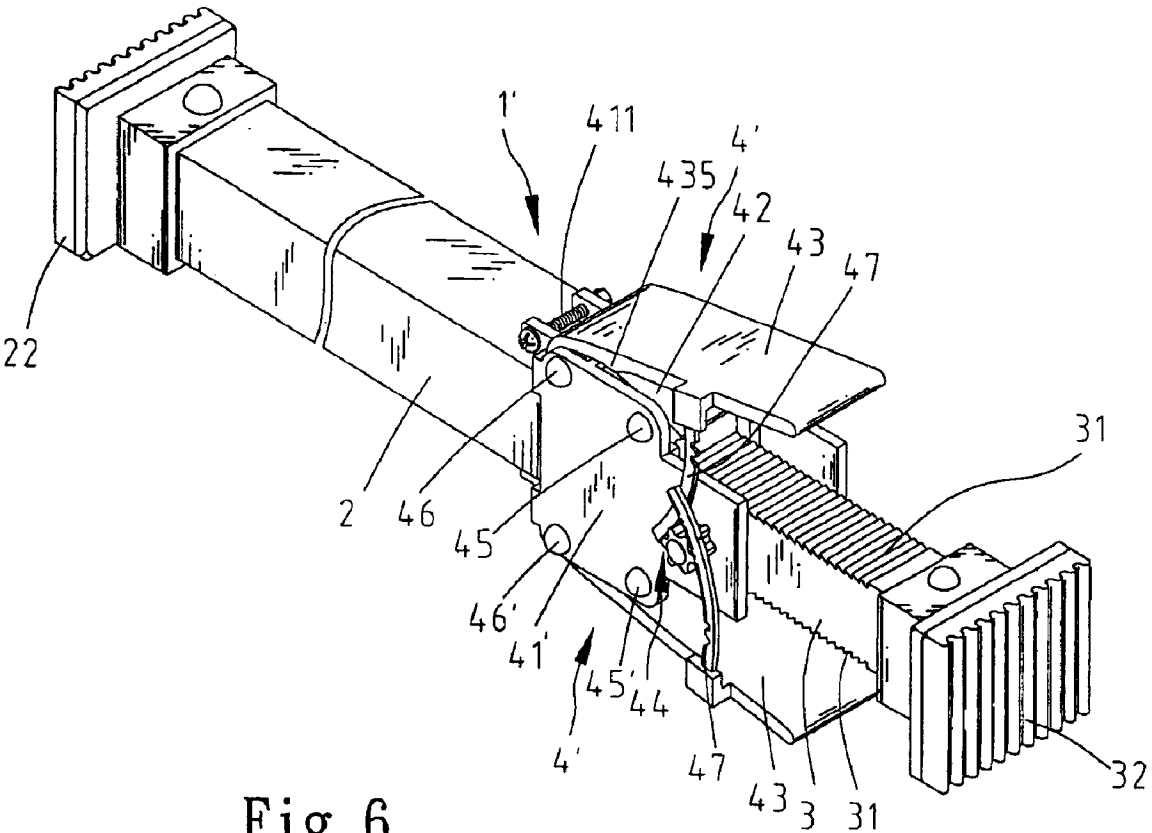
FIG. 6 is a perspective view of a telescopic support according to a second embodiment of the present invention.
Figure 7:
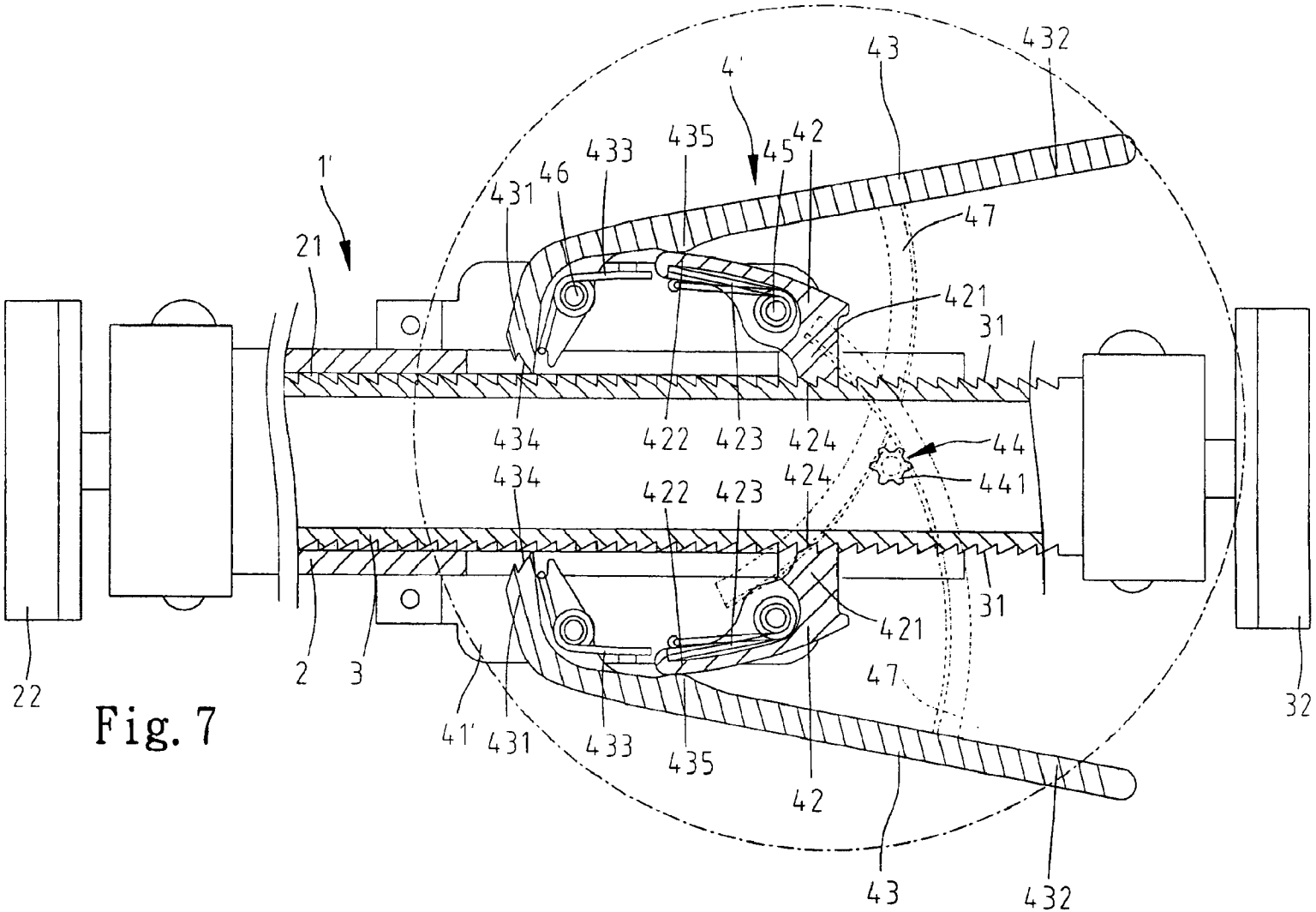
FIG. 7 is a cross-sectional view of the telescopic support of FIG. 6.
Figure 8:
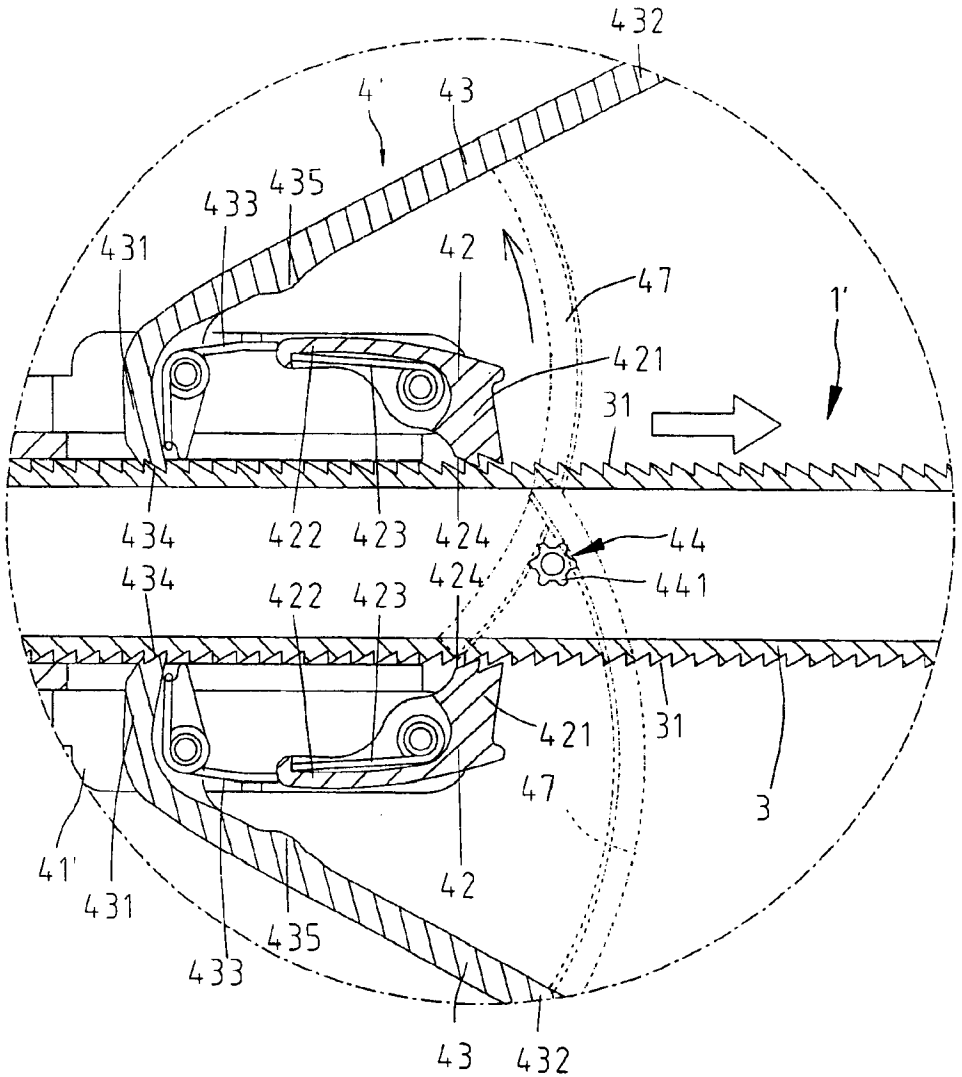
FIG. 8 is a partial view of the telescopic support of FIG. 7.
Figure 9:
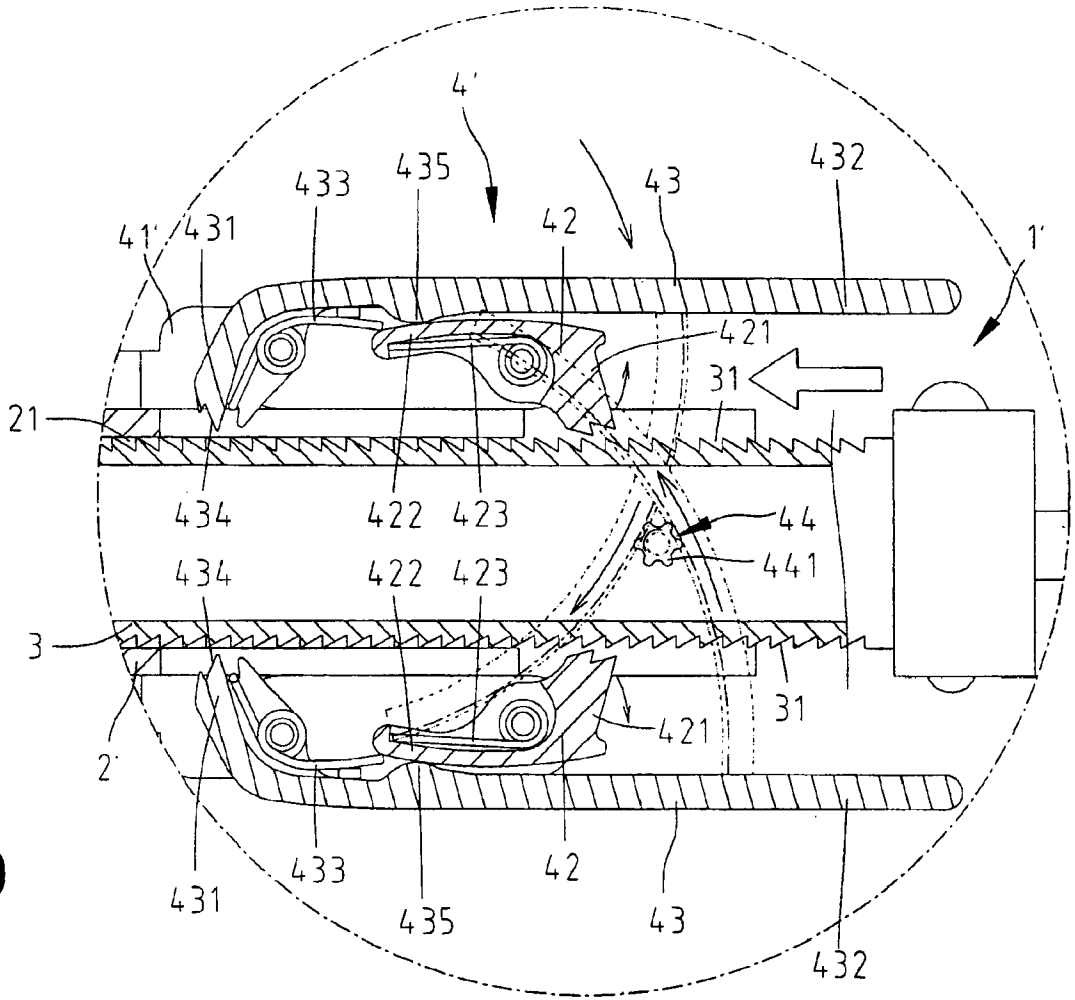
FIG. 9 is similar to FIG. 8 but shows the telescopic support in a different position.
Figure 10:
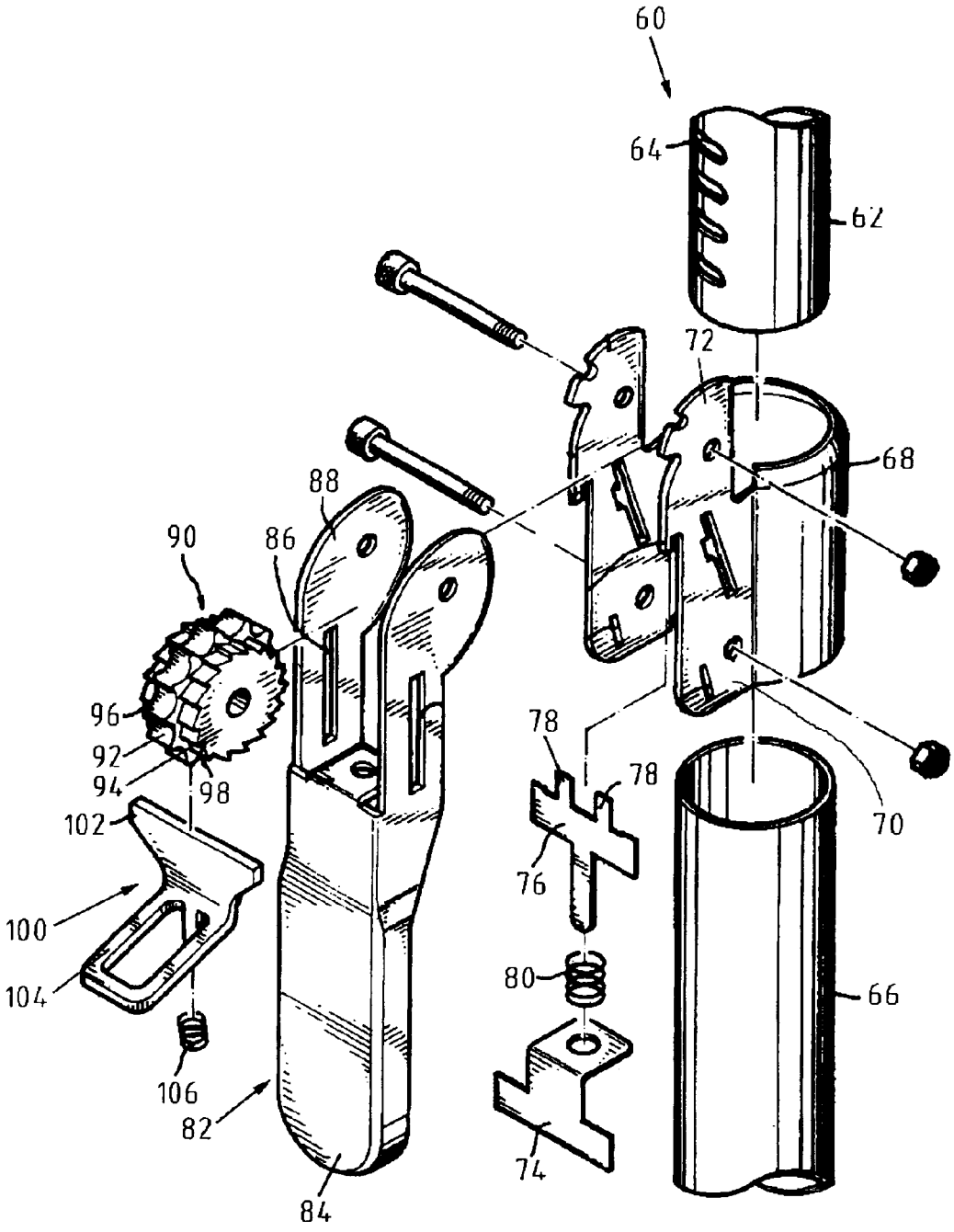
Fig. 10 PRIOR ART
FIG. 10 is an exploded view of a conventional telescopic support.
Figure 11:
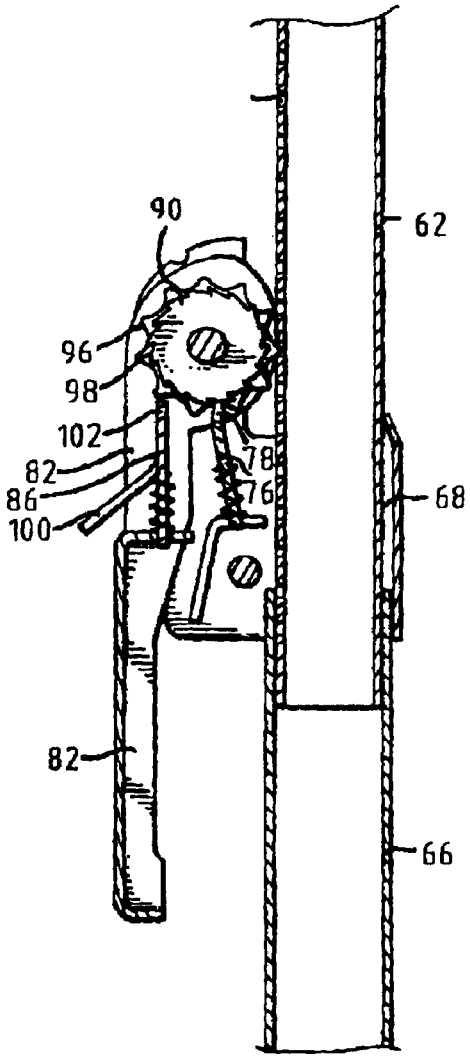
Fig. 11 PRIOR ART
FIG. 11 is a cross-sectional view of the telescopic support of FIG. 10.
Figure 12:
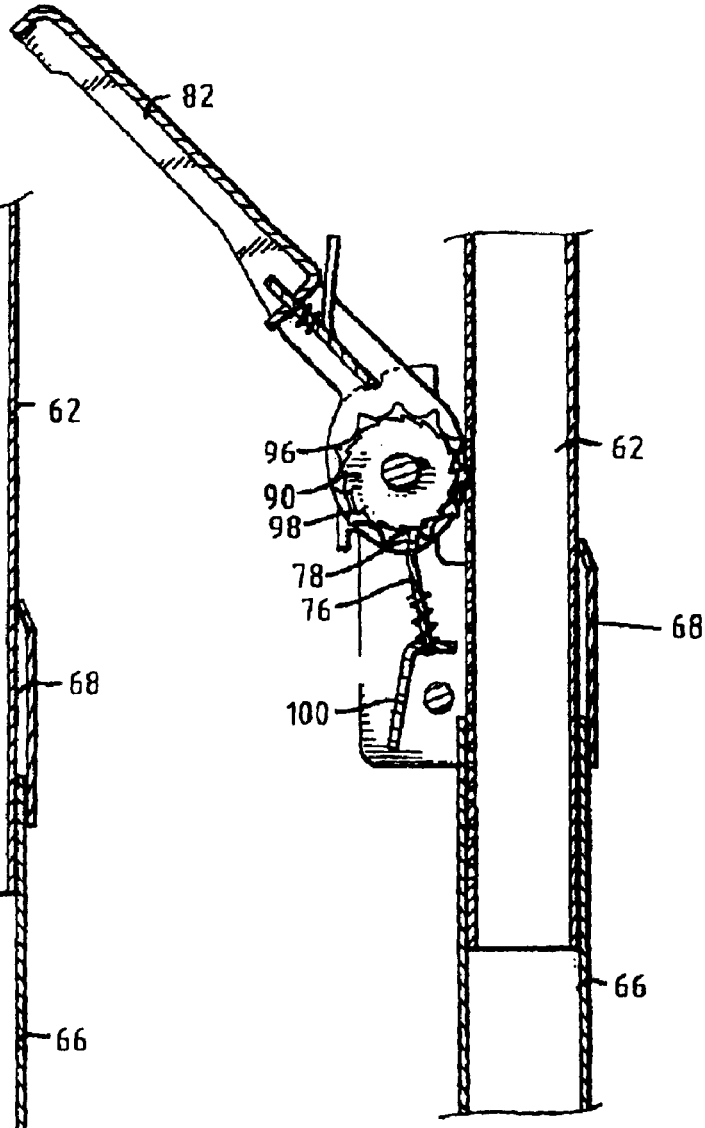
Fig. 12 PRIOR ART
FIG. 12 is similar to FIG. 11 but shows the telescopic support in a different position.

Referring to FIG. 5, driving element 43 is pivoted in a second direction opposite to the first direction so that the convex portion 435 are brought into contact with the lever 422 of the locking element 42. The driving element 43 is further pivoted in the second direction so that the ratchets 424 are disengaged from the ratchets 31. Thus, the internal tube 3 can be inserted into the external tube 2.

FIGS. 6–9 show a telescopic support 1' according to a second embodiment of the present invention. The second embodiment is identical to the first embodiment except for four points. Firstly, the internal tube 3 of the second embodiment includes an additional series of ratchets 31. Secondly, the second embodiment includes a driving and locking device 4' instead of the driving and locking device 4. The driving and locking device 4' includes an additional set of locking elements 42 and 43. The additional set of locking elements 42 and 43 are for engagement with the additional series of ratchets 31. Thirdly, the additional driving and locking device 4' includes two plates 41' instead of the frame 41. Fourthly, the driving element 43 of each set includes a rack 47 extending from the lever 432. Fifthly, on one plate 41' is rotationally mounted a pinion 44 having teeth 441 engaged with the racks 47. Thus, as one set of locking elements 42 and 43 is operated, the other set of locking elements 42 and 43 is pivoted too.

The above-mentioned embodiments are directed to compression-type telescopic supports. However, the present invention can be applied to tension-type supports. To this end, the ratchets 31, 424 and 434 must all be arranged in an opposite orientation. Accordingly, the locking element 42 and the driving element 43 must be switched in position. Moreover, the tube 2 and the internal tube 3 are hooked to two walls instead of abutted against two walls.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. A telescopic support including a tube, an elongated element inserted in the tube and formed with a series of ratchets, and a driving and locking device including:

a locking element including a jaw formed with at least one ratchet and being pivotally installed on the tube;

a spring provided between the tube and the locking element for biasing the ratchet of the locking element into engagement with the ratchets of the elongated element; and a driving element including a jaw formed with at least one ratchet, wherein the driving element can be pivoted on the tube in a direction so as to engage the ratchet thereof with the ratchets of the elongated element and in an opposite direction so as to disengage the ratchet thereof from the ratchets of the elongated element and pivot the locking element for disengaging the ratchet of the locking element from the ratchets of the elongated element.

2. The telescopic support of claim 1 wherein the elongated element cannot be drew back into the external tube when the ratchet of the locking element is engaged with the ratchets of the elongated element.

3. The telescopic support of claim 1 wherein the elongated element cannot be extended from the external tube when the ratchet of the locking element is engaged with the ratchets of the elongated element.

4. The telescopic support of claim 1 further including a spring provided between the tube and the driving element for biasing the ratchet of the driving element from the ratchets of the elongated element.

5. The telescopic support of claim 1 wherein the locking element includes a lever extending from the jaw thereof.

6. The telescopic support of claim 1 wherein the driving element includes a lever extending from the jaw thereof.

7. The telescopic support of claim 1 wherein the locking element includes a lever extending from the jaw thereof, and the driving element includes a lever extending from the jaw thereof, and the lever of the driving element can contact the lever of the locking element.

8. The telescopic support of claim 7 wherein the lever of the driving element is formed with a convex portion for contact with the lever of the locking element.

9. The telescopic support of claim 1 wherein the driving and locking device includes a frame on which the locking element and the driving element are mounted.

10. A telescopic support including a tube, an elongated element inserted in the tube and formed with a series of ratchets, and a driving and locking device with two sets each including:

a locking element including a jaw formed with at least one ratchet and being pivotally installed on the tube;

a spring provided between the tube and the locking element for biasing the ratchet of the locking element into engagement with the ratchets of the elongated element; and a driving element including a jaw formed with at least one ratchet, wherein the driving element can be pivoted on the tube in a direction so as to engage the ratchet thereof with the ratchets of the elongated element and in an opposite direction so as to disengage the ratchet thereof from the ratchets of the elongated element and pivot the locking element for disengaging the ratchet of the locking element from the ratchets of the elongated element.

11. The telescopic support of claim 10 wherein the elongated element cannot be drew back into the external tube when the ratchet of the locking element is engaged with the ratchets of the elongated element.

12. The telescopic support of claim 10 wherein the elongated element cannot be extended from the external tube when the ratchet of the locking element is engaged with the ratchets of the elongated element.

13. The telescopic support of claim 10 further including a spring provided between the tube and the driving element for biasing the ratchet of the driving element from the ratchets of the elongated element.

14. The telescopic support of claim 10 wherein the locking element includes a lever extending from the jaw thereof.

15. The telescopic support of claim 10 wherein the driving element includes a lever extending from the jaw thereof.

16. The telescopic support of claim 10 wherein the locking element includes a lever extending from the jaw thereof, and the driving element includes a lever extending from the jaw thereof, and the lever of the driving element can contact the lever of the locking element.

17. The telescopic support of claim 16 wherein the lever of the driving element is formed with a convex portion for contact with the lever of the locking element.

18. The telescopic support of claim 10 wherein the driving and locking device includes a frame on which the locking element and the driving element of each of the sets are mounted.

19. The telescopic support of claim 18 wherein the driving and locking device includes a pinion pivotally installed on the frame, and each of the sets includes a rack extending from the locking element for engagement with the pinion.

* * * * *